United States Patent [19]

Hwang

[11] Patent Number: 5,048,155

[45] Date of Patent: Sep. 17, 1991

[54] SET SCREW FIXING DEVICE FOR SPRING HINGE

[75] Inventor: Kyu B. Hwang, Daeku, Rep. of Korea

[73] Assignee: Hyundae Precision Co., Ltd., Daeku, Rep. of Korea

[21] Appl. No.: 405,537

[22] Filed: Sep. 11, 1989

[51] Int. Cl.[5] ..... E05F 1/08

[52] U.S. Cl. ..... 16/301

[58] Field of Search ..... 16/300, 301, 298, 299

[56] References Cited

U.S. PATENT DOCUMENTS

| | | | |
|---|---|---|---|
| 142,855 | 9/1873 | Joyce | 16/300 |
| 309,104 | 12/1884 | Shaw | 16/300 |
| 808,138 | 12/1905 | Carroll | 16/298 |
| 900,501 | 10/1908 | Falkenrath | 16/301 |
| 3,825,973 | 7/1974 | Gwozdz | 16/300 |
| 3,965,533 | 6/1976 | Frohlich | 16/301 |
| 4,419,788 | 12/1983 | Prout | 16/300 |
| 4,583,262 | 4/1986 | Werner | 16/300 |
| 4,756,051 | 7/1988 | Shy | 16/299 |

FOREIGN PATENT DOCUMENTS

| | | | |
|---|---|---|---|
| 0258540 | 12/1964 | Australia | 16/301 |
| 0372500 | 3/1923 | Fed. Rep. of Germany | 16/300 |

*Primary Examiner*—Kurt Rowan
*Assistant Examiner*—James Miner
*Attorney, Agent, or Firm*—Fliesler, Dubb, Meyer & Lovejoy

[57] ABSTRACT

A set screw fixing device for a spring hinge capable of executing the fixing work of the set screw simply and easily by making a few passing holes to the upper pintle for according with both the pin holes and the screw hole simultaneously so as to insert a temporary fixing pin to stop the turned pintle for giving the returning elasticity to the torsion spring. The device comprises a few passing holes penetrated radially with predetermined angular intervals to the upper pintle so as any one of them may be accorded with the pin holes simultaneously with the screw hole by another neighbouring passing hole, and a temporary fixing pin.

1 Claim, 3 Drawing Sheets

SET SCREW FIXING DEVICE FOR SPRING HINGE

BACKGROUND OF THE INVENTION

The present invention relates to a set screw fixing device for a spring hinge capable of closing an opened door or returning automatically to the position before the opening, and particularly to a set screw fixing device for a spring hinge which is possible to fix simply a turned pintle by utilizing a fixing pin for the temporary setting inserted through pin holes of a hinge knuckle and a passing hole penetrated radially at the pintle of its interior so that rendering to execute simply and easily the fixing operation of set screw by according exactly the screw hole of hinge knuckle with the passing hole of pintle.

Heretofore, various kinds of hinge that unfolded hinge is made possible to fold automatically by utilizing the returning elasticity of a torsion coil spring (hereinafter, referred to as a torsion spring) have been suggested and utilized, and the control means of torsional force for making possible to control voluntarily the torsional force of the torsion spring is provided to the spring hinge.

For an example of the torsional force control means of conventional spring hinge as such, it is constructed such that a plurality of fixing holes having a predetermined depth are arranged with equal distance interval on an outer peripheral surface of an upper pintle which is fixed with one end of torsion spring and being made possible to control the torsional force of its torsion spring, a screw hole being made possible to accord with said pin holes in response to the turning of the pintle is formed at the hinge knuckle of one side hinge plate inserted with said pintle, and when adjusting the torsional force of the spring hinge, at a state that one end of a hexagonal wrench is inserted to the wrench head inserting hole of hexagonal section formed on the top surface of said pintle, after turning this and making to accord the screw hole of the hinge knuckle with said pin hole of the pintle, tightening the set screw to be tightened to its screw hole and making the front end portion of said set screw to be inserted to the pin hole of accorded pintle, so that a required torsional force of torsion spring can be obtained.

However, in adjusting the torsional force of the torsion spring by utilizing the torsional force control means of conventional spring hinge as this, at a state that the fixing groove of the pintle and the screw hole of the hinge knuckle are made accord by handling a wrench with one hand, inserting a set screw to the screw hole of the hinge knuckle accorded with said fixing groove of the pintle and then tightening the set screw by another wrench with the other hand. In such a conventional fixing work, since it is required that the fixing hole of the pintle and the screw hole of the hinge knuckle are precisely accorded with each other by grasping with one hand the pintle being applied with a strong restoring force of the torsion spring until the set screw is completely tightened, there has been a difficulty and problem that, in case when the power of hand grasping the wrench is loosened, the wrench being tightening the pintle is released away by the strong returning force of the torsion spring, as a result, an accident arises that the pintle made to return becomes rapidly released, so that not only the anxiety for getting hurt during operation becomes impossible to exclude the relative position of screw hole and fixing groove accorded at the time of tightening operation of set screw being operated with another wrench is voluntarily moved and displaced and becoming impossible to maintain exactly the accorded state of screw hole and fixing groove, accordingly either the unreasonable coupling of the set screw arises or the complete coupling of the set screw becomes impossible, so that the fixing of the set screw becomes impossible to surely to obtained.

SUMMARY OF THE INVENTION

Therefore, it is a primary object of the present invention to provide a set screw fixing device of spring hinge which does not have such various difficulties and problems as aforementioned.

Another object of the present invention is to provide a set screw fixing device of spring hinge that, at the time of handling by the turning of pintle for adjusting the torsional force of the torsion spring, firstly making a pin for the temporary setting (hereinafter, referred to as a temporary fixing pin) to pass through so as to be inserted through the pin holes formed at both sides of screw hole on the hinge knuckle, and one passing hole of a few number of passing holes arranged radially at said pintle, in a state that separate screw hole is accorded with another passing hole, and coupling the set screw to a screw hole, so that the fixing operation of the set screw can be executed simply and easily, and the exact coupling of the set screw for the pintle can be obtained.

According to an embodiment of the device of the present invention for attaining the objects as above, a few number of passing holes for passing through both sides and the center of said pintle are arranged radially to the pintle which is inserted through an upper hinge knuckle of one side hinge plate (hereinafter, referred to as a "movable side hinge plate") and an upper portion of a hinge knuckle of the other side hinge plate (hereinafter, referred to as a "fixing side hinge plate") and being fixed with one end of the torsion spring at its bottom end, and the screw hole to be coupled with usual set screw, and two pin holes being possible to be accorded with any one passing hole of the passing holes of said pintle are formed at the upper side of hinge knuckle of said fixing side hinge plate so as to be confronted each other based on the center of the hinge knuckle.

The screw hole and both pin holes of said hinge knuckle are arranged with predetermined distance interval so as to be accorded simultaneously always with neighbouring two pin holes of each passing hole provided radially along with the radial direction of said pintle.

In the present invention as this, at the time of the turning of the pintle for controlling the torsional force of the torsion spring and the fixing of the set screw for fixing the turned pintle, firstly turning the pintle by a wrench to an appropriate position, and in a state that the pin hole of the hinge knuckle is accorded with any one of the passing holes of said pintle, when the temporary fixing pin is inserted through the holes accorded with each other, since no force becomes applied to the wrench having turned said pintle, said wrench becomes possible to separate and release simply from the pintle, in a state as this, the screw hole neighbouring to the pin hole in which said temporary fixing pin is inserted becomes automatically maintained in a state that it is accorded with another neighbouring hole of said pintle contained therein.

Therefore, when the set screw inserted to the screw hole is turned by utilizing another wrench at this moment, becoming possible to couple smoothly without any difficulty, and the set screw fixed as this becomes possible to be exactly and surely coupled and fixed to the passing hole of the hinge knuckle, in a state as this, the temporary fixing pin inserted to said internal and external pin hole is rendered to separate, so that the desired torsional force control of the torsion spring and the fixing operation of the set screw can be easily obtained.

The above objects and other objects as well as features of the present invention can be understood further in detail by considering the following detailed description which will be described with reference to the accompanying drawings.

BRIEF DESCRIPTION OF THE DRAWINGS

FIG. 3 is a cross sectional view taken along the line III—III of FIG. 2, FIGS. 4A to 4C are sectional views for showing in step manner the torsional force control of a coil spring and the coupling process of a set screw of the present invention, in which.

DETAILED DESCRIPTION OF THE INVENTION

Figure 1:
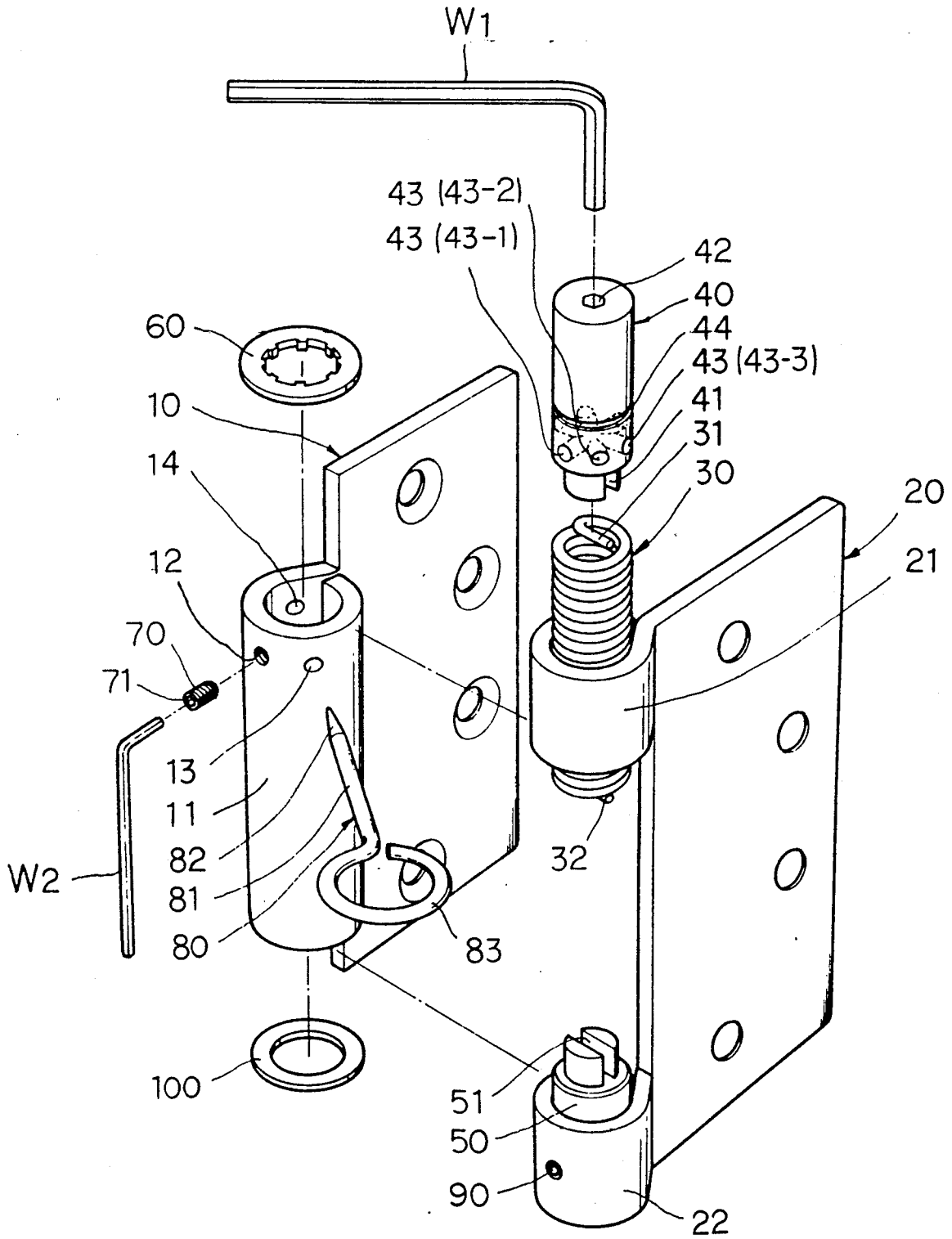
FIG. 1 is an exploded perspective view of a spring hinge provided with a fixing device according to the present invention.
Figure 2:
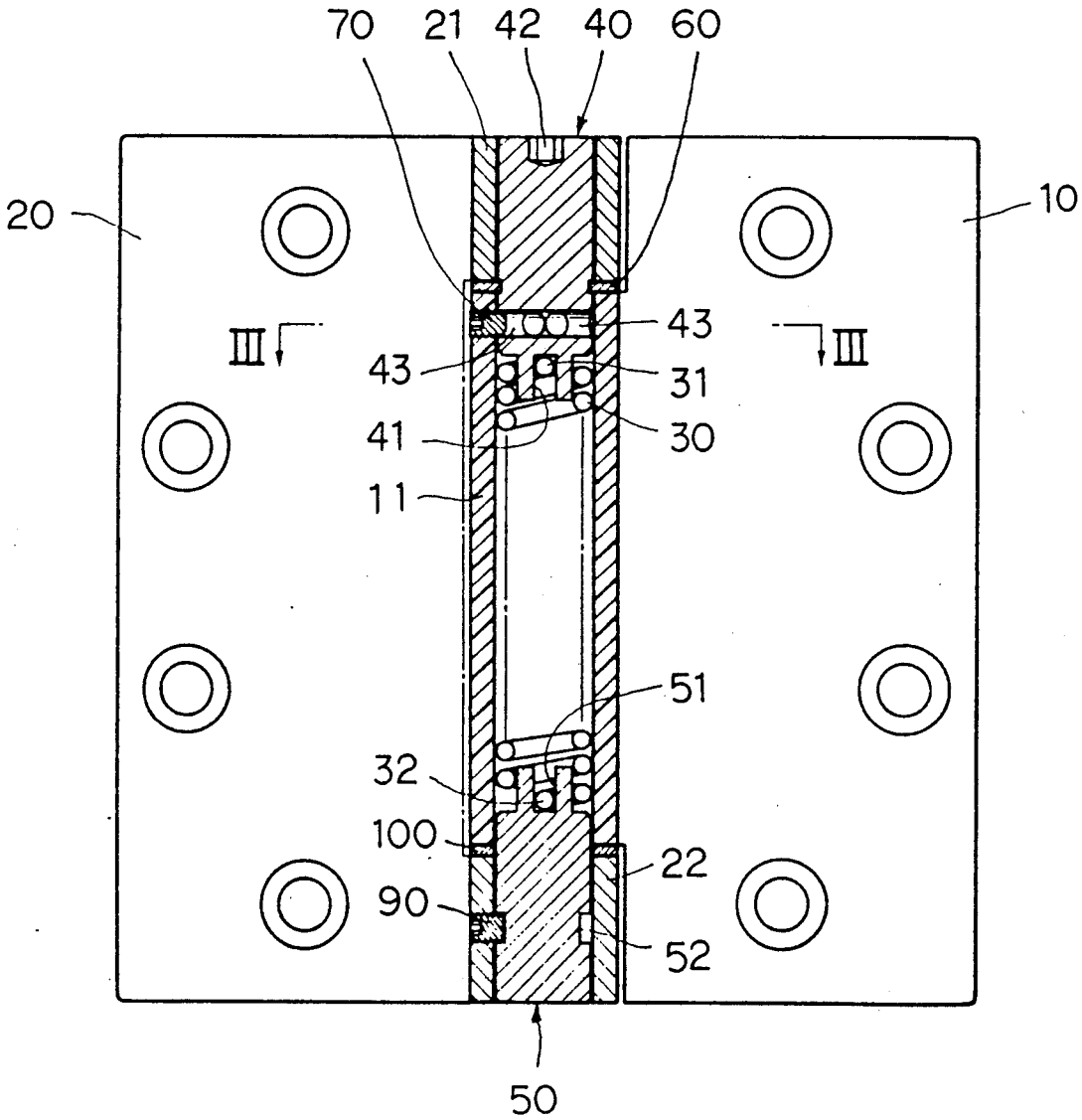
FIG. 2 is a longitudinal sectional view for illustrating the assembled state of the spring hinge of the present invention.
Figure 4A:
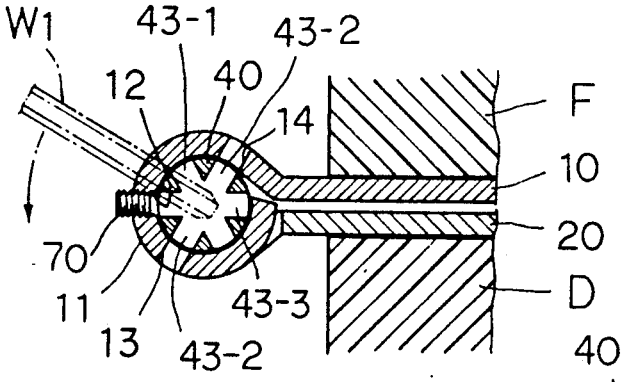
FIG. 4A is a schematic diagram for showing a turning state of a pintle by a wrench.
Figure 4B:
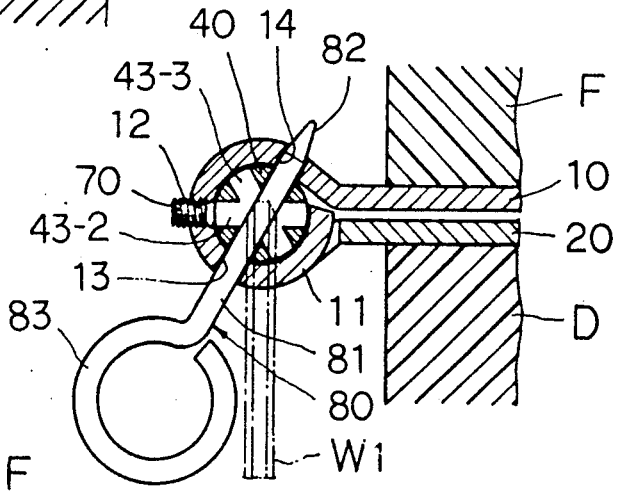
FIG. 4B is a schematic diagram for showing a state that a temporary fixing pin is inserted in a state that a passing hole of the turned pintle and a pin hole of the hinge knuckle are accorded.
Figure 4C:
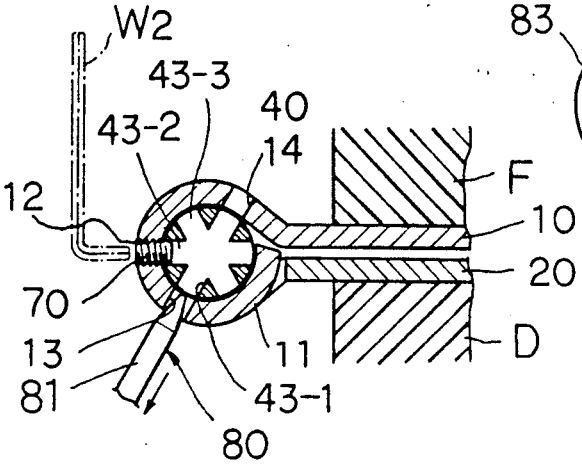
FIG. 4C is a schematic diagram for showing a state the temporary fixing pin is releasing in a state that the set screw is coupled.

FIG. 1 is an exploded perspective view showing a spring hinge, and a wrench and a temporary fixing pin required for the control of the torsional force of a torsion spring and the fixation of a set screw according to a preferred embodiment of the present invention, FIG. 2 is a longitudinal sectional view showing an assembled state of a spring hinge, and FIGS. 4A to 4C are schematic diagrams for showing in step manner the process of the control of torsional force and the fixing of set screw according to the present invention, in the drawings, reference numerals 10 and 20 represent a fixing side hinge plate to be fixed to a door frame F and a movable side hinge plate to be fixed to a door D, respectively. A hollow cylindrical type fixing side hinge knuckle 11 in which a torsion spring 30 is inserted is formed at the intermediate portion of one side edge of said fixing hinge plate 10, movable side hinge knuckles 21 and 22 which are formed at upper and lower portions respectively of one side edge of the movable hinge plate 20 are disposed at the upper and lower end portions of said hinge knuckle 11 and turning together with the movable hinge plate 20 at the time of opening the door D, and upper and lower pintles 40 and 50 provided respectively with cut out fixing grooves 41 and 51 to be inserted respectively with both end portions 31 and 32 of said torsion spring 30 are mounted so as to be confronted each other to the interior of the upper and lower hinge knuckles 21 and 22.

A wrench groove 42 being able to insert with one end of a hexagonal wrench W1 is formed at the center of the top surface of the cylindrical body of said upper pintle 40, a few number of passing holes 43:43-1, 43-2 and 43-3 penetrating through both sides, i.e., to radial direction passing through the center of the pintle 40 are provided radially with predetermined angular distance interval, and annular groove 44 in which a locking washer 60 is inserted is formed on the circumferential surface of upper portion of those passing holes 43.

A screw hole 12 for coupling with said set screw 70 is formed at a side surface of upper portion of the knuckle 11 of said fixing side hinge plate 10 in which the lower portion of the body of the upper pintle 40 is inserted, and two pin holes 13 and 14 being possible to be inserted with a temporary fixing pin 80 according to the present invention are formed at both sides of said screw hole 12 so as to be confronted on the basis of the center axis of the hinge knuckle 11, i.e., along with diametral direction of the hinge knuckle 11.

The screw hole 12 and both of pin holes 13 and 14 are arranged with predetermined angular distance interval so as to be simultaneously accorded always with mutually neighbouring two passing holes 43-1 and 43-2; 43-2 and 43-3; or 43-3 and 43-1 of several number of passing holes 43-1, 43-2 and 43-3 radially arranged to said upper pintle 40, so that a temporary fixing pin 80 for inserting through one side pin hole 13 of the hinge knuckle 11 can be passed through other side pin hole 14 of the hinge knuckle 11 to the exterior thereof through any one passing holes 43-1, 43-2 and 43-3 of each passing hole 43 of the pintle 40 contained within its interior, and in this state, said screw hole 12 of the hinge knuckle 11 is set so as to be always accorded with any one of other passing holes 43 of the pintle 40.

The temporary fixing pin 80 is formed with a needle shaped portion 82 at the front end of linear portion 81 having sufficient length to penetrate the passing hole 43 of upper pintle 40 and both of passing holes 13 and 14 of the hinge knuckle 11, and annular handling ring 83 is provided at opposite side.

On the other hand, the lower pintle 50 inserted to said lower hinge knuckle 20 is coupled with set screw 90 to be inserted through the screw hole of the lower hinge knuckle 22 to the annular groove 52 (FIG. 2) formed at the intermediate portion of the circumference so as to prevent voluntary releasing of the lower pintle 50, and the lower pintle 50 is fixed with the lower hinge knuckle 22 so as not to be voluntarily turned by a fixing means which is not shown in the drawing.

In the drawings, reference numeral 100 is a plane washer interposed between the top end of the movable side lower hinge knuckle 22 in which said lower pintle 50 is inserted and the bottom end of the fixing side hinge knuckle 11, 71 is a wrench hole of said set screw 70, and W2 is another hexagonal wrench for tightening the set screw 70.

Set screw fixing procedure for controlling the torsional force of the torsion spring of the spring hinge of the present invention constructed as above and the operation and effect thereof are as follows.

FIG. 4A shows, in a state that the fixing side hinge plate 10 and the movable side hinge plate 20 of the spring hinge according to the present invention are respectively fixed to the door frame F and the door D, by exemplifying first step for turning the pintle 40 connected with the top end of the torsion spring 30 to give returning elasticity to said torsion spring 30, at this moment, the front end portion of the set screw 70 coupled to the screw hole 12 of the fixing side hinge knuckle 11 is positioned to the exterior side of the internal end portion of the screw hole 12, showing the state that the turning of the pintle 40 within the interior thereof is free.

Accordingly, in the state as this, in order to turn the pintle 40 and fixing by set screw 70, inserting the front end of the wrench W1 into the wrench hole formed on the top surface of said pintle 40, and when turning said wrench W1 in the counterclockwise direction shown by arrow, while the pintle 40 is turning to same direction, turning the torsion spring 30 connected to its bottom in a direction of winding and giving the returning elasticity to said torsion spring 30, in this state, after according said screw hole 12 of the hinge knuckle 11 with any one of one side passing holes 43 of the pintle 40, and screwing in the set screw 70 inserted into said screw hole 12 to thereby fix the pintle 40.

Figure 3:
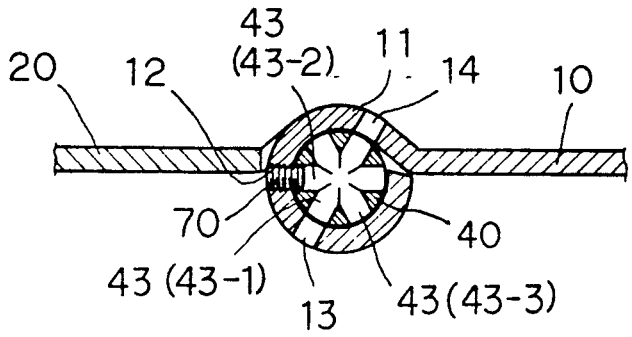

However, since the hinge knuckle 11 of the present invention is formed with two pin holes 13 and 14 respectively other than said screw hole 12, and these respective pin holes 13 and 14 and screw hole 12 are arranged so as to be simultaneously accorded always with two passing holes 43 provided with neighbouring each other at the pintle 40 of its interior as aforementioned, in the present invention, as shown in FIG. 3B, in a state that the pintle 40 is turned as much as desired angle (shown as turned 120° in the drawing) by using wrench and rendering one passing hole 43-1 of said passing holes 43 to be accorded with the pin hole 13 of the hinge knuckle 11, seizing said handle 83 of the temporary fixing pin 80, and inserting in said linear portion 81 through the accorded pin holes 13 and 14 and the passing hole 43-1, and thereby the pintle 40 for operating with the returning elasticity of the torsion spring 30 can be easily fixed as shown in FIG. 3B.

At this moment, since the pin holes 13 and 14 and passing holes 43 for fixing the temporary fixing pin 80 as described above are formed in a state that are penetrated each other through said hinge knuckle 11 as well as one side circumferential wall surface and its opposite side circumferential wall surface of the pintle 40, i.e., along with diametral direction, the accorded condition of the passing holes 43 becomes possible to be easily identified through one side pin hole 13 and other side pin hole 14, and the linear pin portion 81 of the temporary fixing pin 80 having the needle portion 82 at its front end and handle ring at its rear end becomes possible to insert easily through the accorded pin holes 13 and 14 and the passing hole 43, at the time, the passing hole 43 and the screw hole 12 for the coupling of set screw 70 become possible to accord exactly.

Therefore, in this state, after taking off the wrench W1 inserted into the wrench groove of said pintle 40, tightening the set screw 70 by inserting another wrench W2 into the wrench groove 71 of said set screw 70, and thereby the front end portion of said set screw 70 can be inserted into the one side passing hole 43-2 and the pintle 40 becomes possible to be fixed exactly at its regular position, after that, seizing the handling ring 83 of the temporary fixing pin 80 and pulling it out and taking off, and thereby the fixing operation of the pintle 40 according to the set screw 70 becomes possible to execute simply and exactly.

As described above, in fixing a pintle turned with a predetermined angular distance for giving the returning elasticity to a coil spring by a set screw to be tightened through a screw hole of a movable side hinge knuckle, since the present invention is constructed such that two pin holes arranged oppositely around the center axis of said hinge knuckle are formed at both sides of said screw hole of the hinge knuckle, a few passing holes accorded simultaneously with said screw hole and each of the pin holes are provided at the pintle contained within the interior thereof, at the time of fixing the set screw, the set screw is tightened in a state that the temporary fixing pin is inserted through the pin hole and the passing hole accorded each other and thereby the pintle can be fixed, there are effects that the fixing operation of the set screw for the torsional force control of the torsion spring can be easily executed, and the tightening of the set screw with respect to the pintle is simply and easily carried out.

What is claimed is:

1. A spring hinge including a pintle connected to a torsion spring and including a hinge knuckle adapted to be turned by the pintle and spring when the pintle is fixed to the hinge knuckle, the improvement wherein:

said pintle is in the shape of a cylinder with an outer wall centered about a central axis of rotation and has a plurality of pintle holes, each pintle hole extending radially from the outer wall into the pintle along a pintle hole axis, said pintle hole axis extending radially through and normal to said central axis, the pintle hole axis for one or more of said pintle holes offset from the pintle hole axis for one or more other of said pintle holes by a pintle hole offset angle, said hinge knuckle has an inner knuckle wall forming a cylindrical opening for receiving the pintle such that the pintle is constrained, when not fixed, to rotate within the hinge knuckle about the central axis, said hinge knuckle having a plurality of knuckle holes extending through said knuckle wall, each said knuckle hole oriented along a knuckle hole axis extending radially from and normal to said central axis, the knuckle hole axis for one or more of said knuckle holes offset from the knuckle hole axis for one or more other of said knuckle holes by a knuckle hole offset angle, said pintle hole offset angle equal to said knuckle hole offset angle whereby two or more pintle holes oriented along two or more pintle hole axes are concurrently alignable respectively with two or more knuckle holes oriented along two or more knuckle hole axes, first fixing means for insertion through a first knuckle hole into a first pintle hole to initially fix the alignment of the pintle relative to the hinge knuckle, said first pintle hole extending completely through said pintle, said hinge knuckle having another knuckle hole extending through said knuckle wall, oriented along the knuckle hole axis for said first knuckle hole, and located on the opposite side of said central axis from said first hole, whereby said first fixing means is insertable in a straight line through said first knuckle hole, said first pintle hole and said another knuckle hole, second fixing means for insertion through a second knuckle hole into a second pintle hole, when the pintle is initially fixed by said first fixing means, to finally fix the alignment of the pintle relative to the hinge knuckle.

* * * * *